United States Patent [19]

Costales et al.

[11] 4,385,487

[45] May 31, 1983

[54] CONTROLLED RING DRIVE

[76] Inventors: Manuel Costales; Moustafa I. Hakki, both of P.O. Box 884, Belmont, N.C. 28012

[21] Appl. No.: 146,234

[22] Filed: May 5, 1980

[51] Int. Cl.[3] ..... D01H 7/58; D01H 1/241

[52] U.S. Cl. ..... 57/105; 57/75; 57/122; 57/124

[58] Field of Search ..... 57/75, 93, 94, 95, 99, 57/104, 105, 122, 124

[56] References Cited

U.S. PATENT DOCUMENTS

| | | | |
|---|---|---|---|
| 2,541,238 | 2/1951 | Goree | 57/124 |
| 2,563,187 | 8/1951 | Pennati | 57/124 |
| 3,025,657 | 3/1962 | Noordenbos | 57/75 |
| 4,090,348 | 5/1978 | DeVittorio | 57/105 |
| 4,112,666 | 9/1978 | Costales et al. | 57/105 |
| 4,114,359 | 9/1978 | Creus | 57/104 X |

*Primary Examiner*—John Petrakes

*Attorney, Agent, or Firm*—Wendell Coffee

[57] ABSTRACT

The revolving ring on a spinning machine is rotated by a belt encircling the bottom of the ring holder. The drive pulley is located below the ring upon the spindle rail. An idler is mounted upon the draw works support and directional pulleys are mounted upon the ring rail so that as one portion of the belt from the drive pulley to the ring rail is decreased, that portion of the drive belt from the ring rail to the draw works is increased.

8 Claims, 2 Drawing Figures

CONTROLLED RING DRIVE

CROSS REFERENCE TO RELATED APPLICATIONS

None. However, applicants filed Disclosure Document No. 085,651 on Nov. 7, 1979, which document concerns this application; therefore, by separate letter it is respectfully requested that the document be retained and acknowledgement thereof made.

BACKGROUND OF THE INVENTION

1. Field of the Invention

This invention relates to textile mills for spinning, twisting and twining and more particularly for machines with rotating rings.

2. Description of the Prior Art

Previous workers in the art have suggested that the ring of a spinning machine be rotated. We have patented a machine with a rotating ring, U.S. Pat. Nos. 3,738,094 and 4,023,340. In each of these machines the drive pulley was located on the level approximately horizontal with the point of mid-travel at the base of the ring. The belt and drive pulley drove a disc which drove the ring by a frictional contact. The belt was elastic and compensated for the difference in distance between the ring pulley and the driven disc as the ring rail reciprocated up and down on the bobbin.

By our U.S. Pat. No. 4,112,666 we disclosed a drive belt trained from the drive pulley on the spindle ring around an idler puller and then around a shell on the ring rail. The idler pulleys moved out and in to compensate for the difference in distance between the drive pulley and the ring rail.

By our patent application, Ser. No. 043,738, filed May 30, 1978 and pending at the time of filing this patent application, we disclosed a drive belt by which a plurality of rings could be tangentially driven from a single belt.

SUMMARY OF THE INVENTION

New and Different Function

According to this invention a drive belt extends from a drive pulley located on the spindle rail below the lowest point of travel on the ring rail to an idler on the draw works support which is above the highest point of travel of the ring rail. Directional pulleys are mounted on the ring rail so that the drive belt is trained around the rings. Since the belt from the drive pulleys to the ring rail and from the ring rail to the draw works is parallel to the vertical movement of the ring rail the total length of the belt will not change and, therefore, it is not necessary to use an elastic belt.

Objects of this Invention

An object of this invention is to spin or twist fibrous yarns for a continuous filament.

Another object is to provide an improved drive for a rotating ring upon a textile machine.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 2:
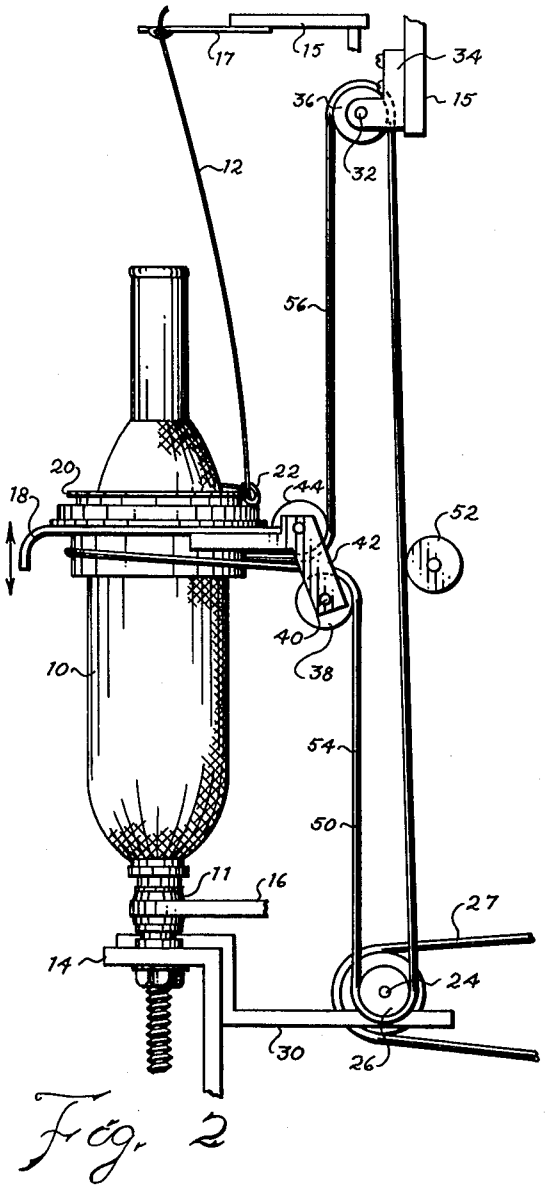
FIG. 2 is a side elevational view thereof.
Figure 1:
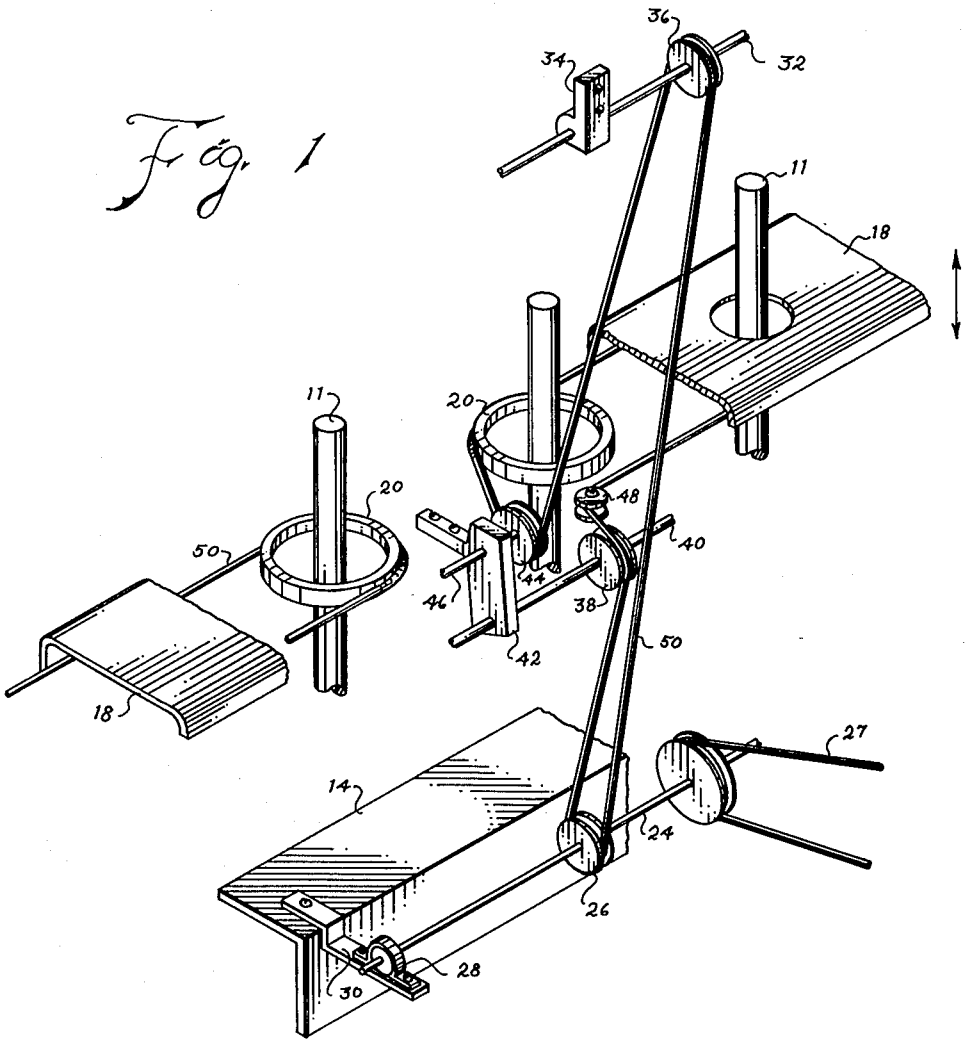
FIG. 1 is a perspective schematic representation of a spinning machine with an embodiment of our invention attached thereto.

Referring to the drawings, there is seen illustrated a conventional spinning machine in many respects. Bobbin 10 has yarn 12 being wound thereon. The bobbin is mounted upon spindle 11 which is journalled to spindle rail 14. Bobbin belt 16 is a portion of a bobbin drive means located upon the frame of the spinning machine for rotating the bobbin at high speed. Ring rail 18 is mounted upon the frame for up and down movement or vertical reciprocation relative to spindle rail 14. This vertical reciprocation of the rail 18 is indicated by a double headed arrow. The yarn 12 is threaded from draw works mounted upon draw works support 15 and extends to the bobbin through thread guide 17.

Those skilled in the art will understand that a machine would have a plurality of bobbins thereon and that the ring rail 18 surrounds each of the bobbins. Also, there would be a plurality of draw works not shown here for clarity in thread guides 17 for each bobbin.

Ring 20 is journalled for rotation upon the ring rail 18. Traveler 22 is slidably mounted upon the ring 20 for movement around the ring and around the bobbin 10. Those skilled in the art will understand that the traveler on each ring is for feeding yarn on to each bobbin.

Drive shaft 24 extends the length of the machine. The drive shaft 24 is attached to the spindle rail 14 by any convenient means, e.g., pillow blocks 28 on a bracket 30 attached to the spindle rail. The shaft 24 is driven by main belt 27 from main cylinder of the machine.

Those having ordinary skill in the art will recognize the structure described to this point is old, either being old and conventional in the art or being shown in prior patents, as shown in our prior U.S. Pat. No. 4,112,666 noted above.

A draw works shaft 32 is attached to the draw works support 15 by a plurality of brackets 34 only one of which is illustrated for clarity. A draw works idler 36 is journalled to the draw works shaft 32 for each drive pulley 26.

A drive directional pulley 38 is journalled to shaft 40 which is attached to the ring rail 18 by directional bracket 42. Draw directional pulley 44 is journalled to shaft 46 which is also attached to the directional bracket 42.

Ring belt 50 is trained around drive pulley 26 and extends to the drive directional pulley 38. From there it extends around third directional pulley 48 to around at least one ring 20. From there it extends around the draw directional pulley 44 to the draw idler 36 and back to the drive pulley 26.

In the drawing or ring belt 50 is illustrated as extending around a plurality of rings 20. It will be understood that the drive belt could extend around two rings without any particular or special arrangements. Also, it will be understood that according to our disclosure in our pending application, noted above, it could extend around as many as six rings or more.

If desired, an additional mid-point or frame idler 52 could bear against the belt as the belt extends from the draw works idler 36 to the drive pulley 26. Besides being adjustable so that tension on the belt 50 could be maintained to a desirable level at all times, the additional idler 52 would reduce any vibration or flapping of the belt.

Analysis of the apparatus will show that the ring belt 50 from the drive pulley 26 to the drive directional pulley 38 could be designated as drive portion 54. Also, that portion of the belt 50 extending from draw directional pulley 44 to the draw works idler 36 could be designated as draw portion 56 for the purpose of analysis. Therefore, it may be seen that if the drive portion 54 is parallel to the up and down motion of the ring rail 18 and if the draw portion 56 is also parallel to this up and down motion, the length of the belt will not change as the ring rail 18 moves up and down. Of course, this parallel relationship could be expressed as the ring rail is caused to move up and down parallel to the portions 54 and 56.

The reason the length of the belt will not change is because as portion 54 decreases, the portion 56 increases the same amount. I.e., the sum of the length or the distance of the portion 54 plus the length or distance of the portion 56 is always the same which is to say that the sum of these two distances is a constant. The ring belt is always kept taut by keeping the length of the belt 50, i.e., the distance it extends around the various pulleys the same.

As an aid to correlating the terms of the claims to the exemplary drawing, the following catalog of elements is provided:

| | |
|---|---|
| 10 bobbin | 30 bracket, spindle rail |
| 11 spindle | 32 shaft, draw works |
| 12 yarn | 34 bracket, draw works |
| 14 spindle rail | 36 idler, draw works |
| 15 draw works support | 38 drive directional pulley |
| 16 bobbin belt | 40 shaft |
| 17 thread guide | 42 bracket, directional |
| 18 ring rail | 44 draw directional pulley |
| 20 ring | 46 shaft |
| 22 traveler | 48 third directional pulley |
| 24 drive shaft | 50 ring belt |
| 26 drive pulley | 52 frame idler |
| 27 belt, main | 54 drive portion |
| 28 pillow block | 56 draw portion |

The embodiment shown and described above is only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific example above do not point out what an infringement of this patent would be, but are to enable the reader to make and use the invention.

We claim as our invention:

1. In a machine having a frame including a. a spindle rail, b. bobbins on the spindle rail, c. bobbin drive means connected to the bobbins for rotating the bobbins at high speed, d. a ring rail around each bobbin mounted on the frame to move up and down, e. a ring on the ring rail around each bobbin, f. each of the rings mounted for rotation on the ring rail, g. a traveler on each ring for feeding yarn to each bobbin, h. a drive pully on the spindle rail, and i. a draw works support above the spindle rail; the improved structure for rotating each ring comprising:

j. a draw idler on the draw works support, k. a draw directional pulley on the ring rail, l. a drive directional pulley on the ring rail, m. a ring belt trained from (i) the drive pulley to (ii) the drive directional pulley around (iii) a plurality of the rings to (iv) the draw directional pulley to (v) the draw idler and back to (vi) the drive pulley.

2. The invention as defined in limitations a. through m. of claim 1 further comprising:

n. a frame idler bearing against the ring belt between the draw idler and drive pulley.

3. The invention as defined in limitations a. through m. of claim 1 further comprising:

n. a third directional pulley on the ring frame.

4. The invention as defined in limitations a. through m. of claim 1 further comprising:

n. the ring belt from the drive pulley to the drive directional pulley and from the draw directional pulley to the draw idler parallel to the line of movement of the ring rail as it moves up and down.

5. The invention as defined in limitations a. through n. of claim 4 further comprising:

o. a third directional pulley on the ring frame.

6. The invention as defined in limitations a. through o. of claim 5 further comprising:

p. a frame idler bearing against the ring belt between the draw idler and drive pulley.

7. The process of rotating rings in a machine having a frame including a. a spindle rail, b. bobbins on the spindle rail, c. bobbin drive means connected to the bobbins for rotating the bobbins at high speed, d. a ring rail around each bobbin mounted on the frame to move up and down, e. a ring on the ring rail around each bobbin, f. each of said rings mounted for rotation on the ring rail, and g. a traveler on each ring for feeding yarn to each bobbin, h. a drive pulley on the spindle rail, i. a draw works support above the spindle rail;

wherein the improved method comprises:

j. extending a ring belt from (i) the drive pulley to (ii) a drive directional pulley on the ring rail, around (iii) a plurality of said rings to (iv) a draw direction pulley on the ring rail to (v) a draw idler on the draw works support, and back to (vi) the drive pulley, while k. at all times maintaining the total of (i) the distance from the drive pulley to the drive directional pulley plus (ii) the distance from the draw directional pulley to the draw idler, the same so that the ring belt is always taut.

8. The invention as defined in limitations a. through k. of claim 7 further comprising:

l. moving the ring rail parallel to those portions of the ring belt which extends from the drive pulley to the drive directional pulley and extends from the draw directional pulley to the draw idler.

* * * * *